US008864281B2

(12) United States Patent
Matsuda et al.

(10) Patent No.: US 8,864,281 B2
(45) Date of Patent: Oct. 21, 2014

(54) PRINTING DEVICE AND PRINTING METHOD

(71) Applicant: Seiko Epson Corporation, Tokyo (JP)

(72) Inventors: Kan Matsuda, Nagano (JP); Katsumi Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 68 days.

(21) Appl. No.: 13/852,475

(22) Filed: Mar. 28, 2013

(65) Prior Publication Data

US 2013/0265351 A1 Oct. 10, 2013

(30) Foreign Application Priority Data

Apr. 4, 2012 (JP) ..... 2012-085695

(51) Int. Cl.
*B41J 29/393* (2006.01)
*B41J 3/407* (2006.01)
*B41J 2/435* (2006.01)

(52) U.S. Cl.
CPC . *B41J 2/435* (2013.01); *B41J 3/407* (2013.01)
USPC ..... 347/19

(58) Field of Classification Search
None
See application file for complete search history.

(56) References Cited

U.S. PATENT DOCUMENTS 6,481,844 B1 * 11/2002 Beery ..... 347/105
6,683,699 B1 * 1/2004 Ashizaki et al. ..... 358/1.18
6,709,080 B2 * 3/2004 Nims et al. ..... 347/1

FOREIGN PATENT DOCUMENTS

JP 2011-158627 A 8/2011

* cited by examiner

*Primary Examiner* — Lamson Nguyen
(74) *Attorney, Agent, or Firm* — Global IP Counselors, LLP

(57) ABSTRACT

To make it possible to print a binocular vision image that is suitably visible in 3D according to the width of the convex lens during printing.

9 Claims, 6 Drawing Sheets

Fig. 7A
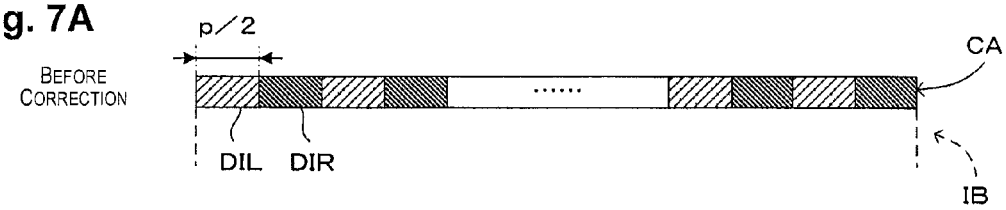
Fig. 7B
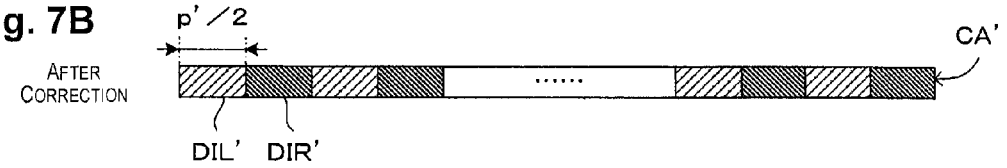
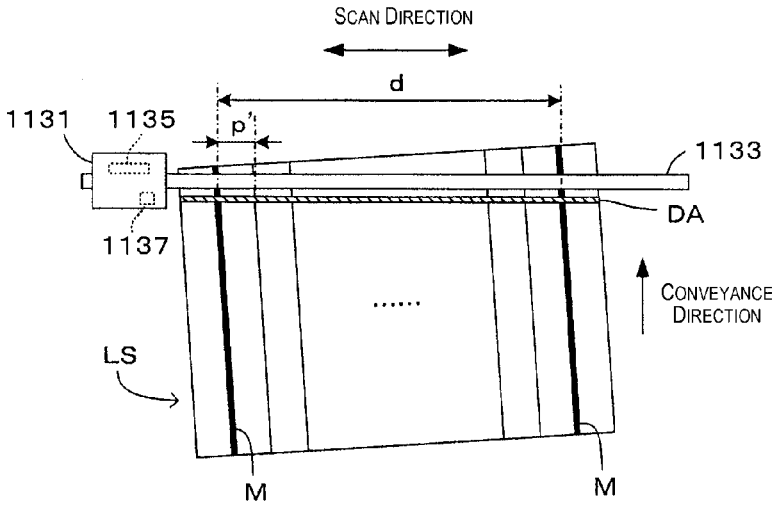
Fig. 8

PRINTING DEVICE AND PRINTING METHOD

CROSS-REFERENCE TO RELATED APPLICATIONS

This application claims can to Japanese Patent Application No. 2012-085695 filed on Apr. 4, 2012. The entire disclosure of Japanese Patent Application No. 2012-085695 is hereby incorporated herein by reference.

BACKGROUND

1. Technical Field

The present invention relates to technology for printing a binocular vision image, for which are aligned strip form images cut out individually from a plurality of original images having disparity with each other, on a lenticular sheet having a lenticular lens formed by aligning a plurality of convex lenses.

2. Background Technology

A technology which prints on a lenticular sheet a binocular vision image created from a plurality of original images having disparity with each other, making the printed image visible as a 3D image via a lenticular lens has been known from the past. Also, as technology for printing with good precision a binocular vision image on a lenticular sheet, noted for example in Patent Document 1 is technology for correcting the tilt of the lenticular sheet when the lenticular sheet is tilted in relation to the conveyance direction.

Japanese Laid-open Patent Publication No. 2011-158627 (Patent Document 1) is an example of the related art.

SUMMARY

Problems to Be Solved by the Invention

To make a binocular vision image printed on a lenticular sheet suitably visible in 3D, an item for which strip form images cut out from each original image are aligned in an amount matching the number of viewpoints, needs to be printed to match the area of the width direction of one convex lens. Said another way, it is necessary to not have each strip form image be printed extending across a plurality of convex lenses. For example, when the lenticular sheet shrinks due to environmental changes such as temperature, for example, and the convex lens width changes, it is necessary to adjust the width of the strip form image to match the width of the convex lens during printing. However, means to address this kind of problem are not noted in Patent Document 1.

By addressing the problem noted above, several of the aspects of the invention make it possible to print a binocular vision image that is suitably visible in 3D according to the width of the convex lens during printing.

Means Used to Solve the Above-Mentioned Problems

One aspect of the invention is a printing device for printing a binocular vision image, for which are aligned strip form images cut out individually from a plurality of original images having disparity with each other, on a lenticular sheet having a lenticular lens formed by aligning a plurality of convex lenses extending in a designated direction, equipped with conveyance means for conveying the lenticular sheet with the lengthwise direction of the convex lens along the conveyance direction, marker detection means for detecting a plurality of markers marked on the lenticular sheet, parallel to each other along the lengthwise direction with a gap of an integral multiple of the convex lens width opened, image data supply means for supplying image data with the width of the strip form image adjusted according to the width of the convex lens found from the detection results of the marker detection means, and printing means for receiving image data supplied from the image data supply means and printing the binocular vision image on the lenticular sheet.

Another aspect of the invention is a printing method for printing a binocular vision image, for which are aligned strip form images cut out individually from a plurality of original images having disparity with each other, on a lenticular sheet having a lenticular lens formed by aligning a plurality of convex lenses extending in a designated direction, having a preparation step of preparing the lenticular sheet on which a plurality of markers are marked parallel to each other along the lengthwise direction of the convex lens with a gap of an integral multiple of the width of the convex lens opened, a conveyance step of conveying the lenticular sheet with the lengthwise direction along the conveyance direction, a marker detection step of detecting the plurality of markers marked on the lenticular sheet, an image data supply step of supplying image data for which the width of the strip form image is adjusted according to the width of the convex lens found from the detection results of the marker detection step, and a printing step of printing the binocular vision image on the lenticular sheet based on the image data supplied at the image data supply step.

With an invention constituted in this way (printing device and printing method), a binocular vision image, for which are aligned strip form images cut out individually from a plurality of original images having disparity with each other, is printed on a lenticular sheet having a lenticular lens formed by aligning a plurality of convex lenses. It is also possible to view an image in 3D by viewing the binocular vision image printed on the lenticular sheet via a lenticular lens. Here, with this invention, by detecting a plurality of markers marked on the lenticular sheet in a state with a gap opened at an integral multiple of the width of the convex lens, it is possible to calculate the width of the convex lens from the distance between markers and the number of convex lenses between the markers. Also, by adjusting the width of the strip form image according to the width of the found convex lens width, it is possible to supply image data for which each strip form image does not extend across a plurality of convex lenses. In fact, the plurality of markers are marked on the lenticular sheet along the lengthwise direction of the convex lens, and the lenticular sheet is conveyed in a state with the convex lens lengthwise direction matching the conveyance direction. Therefore, it is possible to find the width of the convex lens from the results of one marker detection process, and as a result, it is possible to promptly adjust the width of the strip form image based on the marker detection results. As described above, with the invention, it is possible to print a binocular vision image which can be suitably viewed as 3D according to the width of the convex lens during printing.

Here, with the invention, it is preferable that the printing means adjust the printing start position on the lenticular sheet in the direction orthogonal to the conveyance direction based on the detection results of the marker detection means. By the printing means adjusting the printing start position in this way, it becomes possible to align the lenticular sheet and the binocular vision image, making it possible to improve the printing precision.

When there has been an error in the marker detection results, the aforementioned error has an effect when calculating the width of the convex lens based on the distance between markers. Also, when the width of the strip form image is adjusted based on the width of the convex lens having the error, by that error accumulating with the binocular vision image created by aligning the strip form images, the effect of the error becomes greater. In particular, when the number of convex lenses included between markers is small, the calculation error of the convex lens with becomes larger, and it also becomes impossible to ignore the cumulative error described above. In light of that, it is preferable that the image data supply means adjust the width of the strip form image based on the detection results of the plurality of markers marked on the lenticular sheet with a gap of 2 times or greater than the width of the convex lens. Furthermore, it is even more preferable that the image data supply means adjust the width of the strip form image based on the detection results of the markers marked on the two boundary lines positioned at both edges in the direction orthogonal to the lengthwise direction among the boundary lines of the mutually adjacent convex lenses.

It is also acceptable to have the marker detection means perform detection of the markers a plurality of times at different timings for the lenticular sheet conveyed in the conveyance direction, and to have the image data supply means adjust the width of the strip form image based on the detection results of the marker detection means each time the marker is detected. This kind of constitution is preferable because even in a case when a change occurs in the width of the convex lens in the conveyance direction, the width of the strip form image is adjusted according to that width change.

It is also acceptable for the printing means to have a head unit for performing printing on the lenticular sheet while moving it in the direction orthogonal to the conveyance direction, and the marker detection means is provided on that head unit. With this kind of constitution, it is possible to use a head unit movement mechanism as the mechanism for moving the marker detection means, so there is no interference by the marker detection means and the head unit, and it is possible to simplify the device constitution.

It is also acceptable for the marker detection means to perform detection of the marker by receiving the light of the outgoing beams of the wavelength components other than the visible light range from the markers. With this kind of constitution, it is possible to mark markers on the lenticular sheet using ink or the like that is detectable with light in a wavelength component other than the visible light range (e.g. infrared rays or ultraviolet rays). Specifically, it is possible to make the marker difficult to recognize with the human eye, so interference of the marker on the binocular vision image printed on the lenticular sheet can be suppressed.

Also, there are many cases of providing a paper edge detection means that detects the edge of the print medium in the direction orthogonal to the conveyance direction. Also, conveyance control of the print medium is sometimes performed based on the detection results of the paper edge detection means. With the invention as well, it is also of course possible to equip this kind of paper edge detection means, and in that case, if the paper edge detection means and the marker detection means are used jointly, it is possible to reduce the number of parts of the device, which makes this preferable in terms of making the device more compact and suppressing cost increases. Specifically, it is preferable that the marker detection means be constituted so as to detect the edge of the lenticular sheet in the direction orthogonal to the conveyance direction.

BRIEF DESCRIPTION OF THE DRAWINGS

Referring now to the attached drawings which form a part of this original disclosure:

FIGS. 7A and 7B are drawings for explaining correction of the binocular vision image area corresponding to the marker detection area; and FIG. 8 is a drawing showing the state of the lenticular sheet being conveyed at a tilt.

DETAILED DESCRIPTION OF EXEMPLARY EMBODIMENTS

Figure 1:
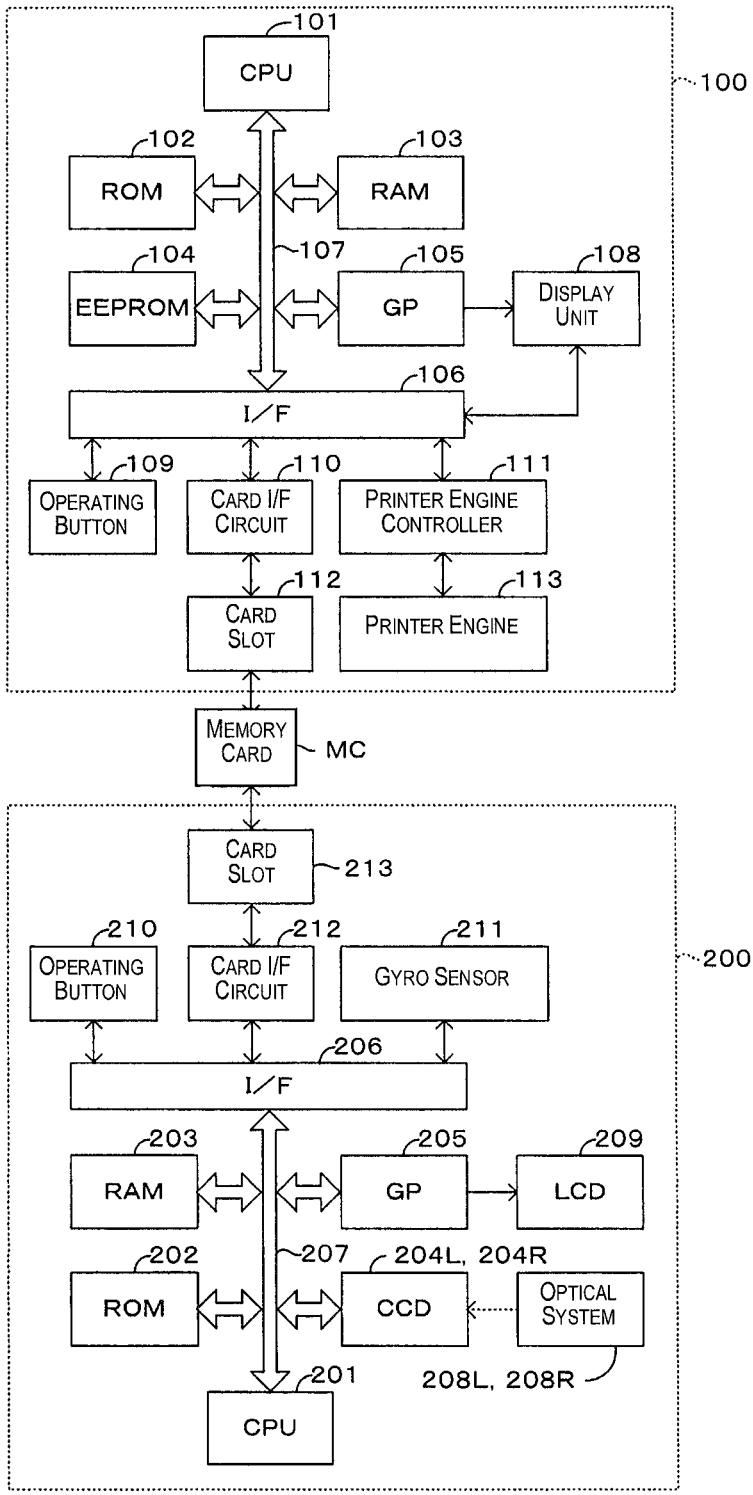
FIG. 1 is a drawing showing a printing system using an embodiment of the image processing device of the invention.

FIG. 1 is a drawing showing a printing system using an embodiment of the image processing device of the invention. This printing system transfers image data fetched by image capture by a digital camera 200 to a printing device 100 using a memory card MC, a USB (Universal Serial Bus) cable, a wireless LAN (Local Area Network) or the like, and prints using a printing device 100. Specifically, here, what is assumed is so-called direct printing whereby a user generates image data by capturing an image using the digital camera 200, that image data is read as is into the printing device 100, and printing is done, but the printing system to which the invention can be applied is not limited to this. In other words, it is also possible to apply the invention to a printing system whereby image data generated by the digital camera 200 is fetched into a personal computer, mobile telephone or the like, and image data is sent to the printing device 100 from the personal computer to do printing.

As shown in the drawing, with the digital camera 200, a CPU (Central Processing Unit) 201, a ROM (Read Only Memory) 202, a RAM (Random Access Memory) 203, a CCD (Charge Coupled Device) 204L and 204R, a graphic processor (GP) 205, and an interface (I/F) 206 are connected to each other via a bus 207, and information can be transferred between these items. Then, the CPU 201 performs control of the digital camera 200 while executing various arithmetic processes according to programs stored in the ROM 202. The data that is temporarily needed at this time is stored in the RAM 203.

Also, the CCD 204L and 204R convert optical images from a photograph condensed by the optical systems 208L and 208R to electrical signals and output those. More specifically, while optical images condensed by the optical system 208L are made incident on the CCD 204L, the optical images condensed by the optical system 208R are made incident on the CCD 204R. The optical systems 208L and 208R are arranged separated at the left and right of the case of the digital camera 200. More specifically, the optical system 208L is provided at the left facing the photographic subject of the front surface of the digital camera 200 case, and the optical system 208R is provided at the right facing the photographic subject. Because of that, disparity arises between the images taken by the CCD 204L and 204R.

The optical systems 208L and 208R are respectively constituted by a plurality of lenses and actuators, and an optical image of the photographic subject is formed on the light receiving surfaces of the respective CCD 204L and 204R by a plurality of lenses while the focus and the like is adjusted by the actuators.

This digital camera 200 is able to selectively execute a stereo imaging mode with which a pair of images having a disparity is imaged using the two CCDs 204L and 204R, and a normal imaging mode for performing imaging using only one CCD. The pair of image data imaged with the stereo imaging mode is saved having been correlated to each other, and in the process of creating a synthetic image for binocular vision described later, the image taken by the CCD 204L is used as the left eye original image, and the image taken by the CCD 204R is used as the right eye original image.

Furthermore, the GP 205 executes image processing for display based on the display instruction supplied from the CPU 201, and the obtained display image data is supplied to the liquid crystal display (LCD) 209 and displayed.

The I/F 206 provides the I/O function of the digital camera 200, and when information is sent and received between the operating button 210, the gyro sensor 211, and the card I/F circuit 212, it is a device that converts the data display format as appropriate. The operating button 210 connected to the I/F 206 has buttons such as for the power supply, mode switch, the shutter and the like, or has input means capable of setting various functions, and with these, the user is able to freely control and operate the digital camera 200. Also, the gyro sensor 211 generates signals indicating the angle of the camera main unit (angle in relation to the horizontal surface) when the photographic subject is captured by the digital camera 200, and outputs those. The digital camera 200 generates various types of information during imaging (e.g. information relating to the exposure, photographic subject and the like), including the aforementioned angle of the camera main unit.

Note that with this embodiment, the digital camera 200 notes the imaging information in Exif (Exchangeable Image File Format) information, and has a structure for which it is possible to create image files attached to image data. This Exif image file structure is basically the normal JPEG (Joint Photographic Experts Group) image format itself, and has data such as thumbnail images, imaging related data and the like embedded within it in a form prepared in compliance with JPEG. Furthermore, it has a function of creating and recording an image file (MPO file) based on the MP (Multi Picture) format in which a plurality of still image data are recorded in one image file as a file format suitable for the stereo imaging mode.

Also, the card I/F circuit 212 is an interface for reading and writing information with the memory card MC inserted in a card slot 213. Furthermore, the I/F 206 has a function of connecting with external devices such as a USB, wireless LAN or the like (not illustrated), and is able to send and receive image files with the printing device 100 using a wired connection or wirelessly.

The printing device 100 is a device for printing images captured using the digital camera 200, and is constituted as follows. With the printing device 100, the CPU 101, the ROM 102, the RAM 103, the EEPROM (Electrically Erasable and Programmable ROM) 104, the GP 105, and the I/F 106 are connected to each other via the bus 107, and information can be sent and received between these. The CPU 101 executes various arithmetic processes according to the programs stored in the ROM 102 and the EEPROM 104, and controls each part of the printing device 100. Also, while programs and data that are subject to execution by the CPU 101 are temporarily stored in the RAM 103, data and the like that are kept even after the printing device power is turned off are stored in the EEPROM 104. Furthermore, when necessary, the CPU 101 gives display instructions to the GP 105, the GP 105 executes image processing for display according to these display instructions, and those processing results are supplied to and displayed on the display unit 108.

The I/F 106 is a device that suitably converts the data expression format when sending and receiving information between the operating button 109, the card I/F circuit 110, and the printer engine controller 111. With the printing device 100, the operating button 109 is constituted to be pressed when performing menu selection or the like of the printing device 100. Also, the card I/F circuit 110 is connected to the card slot 112, and reads the image files generated by the digital camera 200 from the memory card MC inserted into this card slot 112. The I/F 106 also has a function of connecting with external devices such as a USB, wireless LAN and the like (not illustrated), and it is possible to send and receive image files with the digital camera 200 using wired communication or wireless communication.

The display unit 108 is an item for which a touch panel is provided on the surface of a display consisting of an LCD, for example, and in addition to displaying the image data given from the GP 105 on the display, outputs to the I/F 106 the user's operating input data to the touch panel.

Then, when it receives image data via the memory card MC or by data communication, the printing device 100 performs various types of processing by the CPU 101 and controls the printer engine 113 by the printer engine controller 111, and by doing this prints an image corresponding to the image data. Following, we will describe the 3D image printing mode whereby a synthetic image for 3D viewing is created from image data corresponding to a left-right pair of original images captured using the stereo imaging mode of the digital camera 200, and this is printed on a lenticular sheet having lenticular lenses. In addition to this, it is possible to execute various types of printing operations implemented by this type of printer, but there are various known technologies for that kind of printing operation, and it is possible to apply the same technologies to this embodiment as well, so with this specification, we will omit an explanation of those. Also, the principle that makes 3D viewing of an image possible using a lenticular lens is also well known, so an explanation of that will be omitted here.

Figure 2:
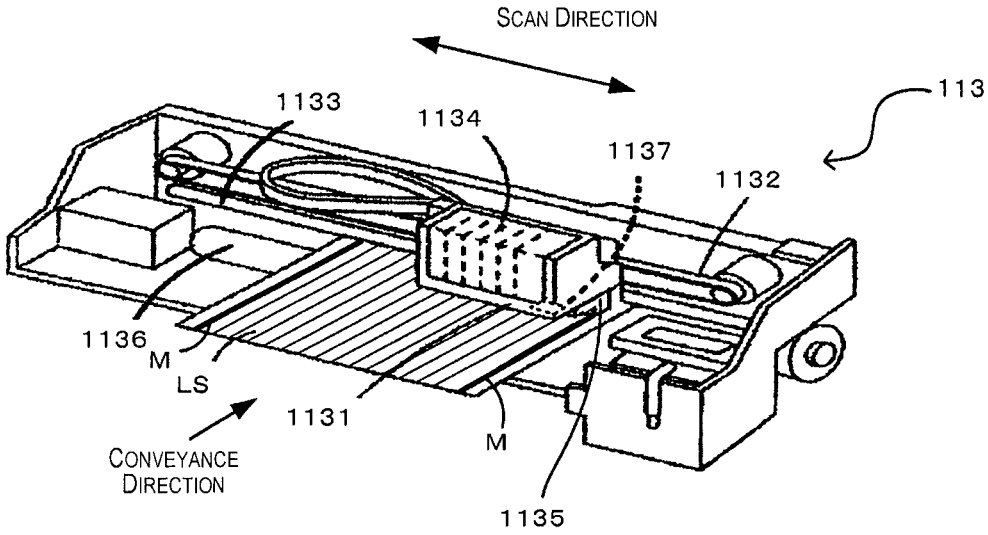
FIG. 2 is a drawing showing the printer engine.

FIG. 2 is a drawing showing a printer engine. A head unit 1131 provided on the printer engine 113 is moved back and forth in the scan direction along a guide 1133 by a timing belt 1132 extending across the scan direction in loop form being driven by a printer engine controller 111. Ink cartridges 1134 which individually hold each color of ink such as cyan, magenta, yellow, black and the like are mounted in the head unit 1131. These ink cartridges 1134 are respectively connected to a printing head 1135. Then, the printing head 1135 applies pressure to the ink from the ink cartridges 1134 and discharges ink from the nozzles (not illustrated) toward the lenticular sheet LS. With this embodiment, the printing head 1135 uses a method of pressurizing ink by deforming a piezo element by applying voltage to the piezo element, but it is also possible to use a method of pressurizing the ink using bubbles generated by heating the ink by applying voltage to a heat resistive element (e.g. a heater or the like).

Also, a conveyor roller 1136 that conveys the lenticular sheet LS in the conveyance direction in the drawing by rotating in a designated direction is provided. The conveyer roller 1136 is rotationally driven by the printer engine controller 111. Then, each time the lenticular sheet LS is conveyed by unit volume in the conveyance direction, the head unit 1131 is moved back and forth in the scan direction orthogonal to the conveyance direction, and a printing process is executed by discharging ink on the lenticular sheet LS. Furthermore, a paper edge detection sensor 1137 is provided further to the upstream side in the conveyance direction than the printing head 1135. This paper edge detection sensor 1137 is equipped with a light emitting element (not illustrated) constituted by light emitting diodes or the like, and a light receiving element (not illustrated) constituted by light receiving sensors such as a photo transistor or the like. Then, the light emitted from the light emitting element is reflected by the lenticular sheet LS, and that reflected light is received by the light receiving element and converted to electrical signals. The presence or absence of the lenticular sheet LS at the lenticular sheet LS left or right edge or front or back edge is detected from the size of the converted electrical signal, and it is possible to find the width and length of the lenticular sheet LS.

The paper edge detection sensor 1137 of this embodiment not only detects the edge of the lenticular sheet LS, but also detects the marker M described later that is marked on the lenticular sheet LS. By jointly using the paper edge detection sensor 1137 as the paper edge detection means and as the marker detection means, it is possible to reduce the number of parts for the printing device 100, and is preferable because it allows the device to be more compact and to keep the costs from increasing. Also, the paper edge detection sensor 1137 of this embodiment is equipped with a light emitting element capable of emitting infrared rays, and a light receiving element capable of receiving infrared rays, but the paper edge detection sensor 1137 can also emit light or receive light that is light of another wavelength range. The paper edge detection sensor 1137 does not absolutely have to be combined with a light emitting element, and the constitution can also be made so as to have light irradiation performed by another part.

Figure 3:
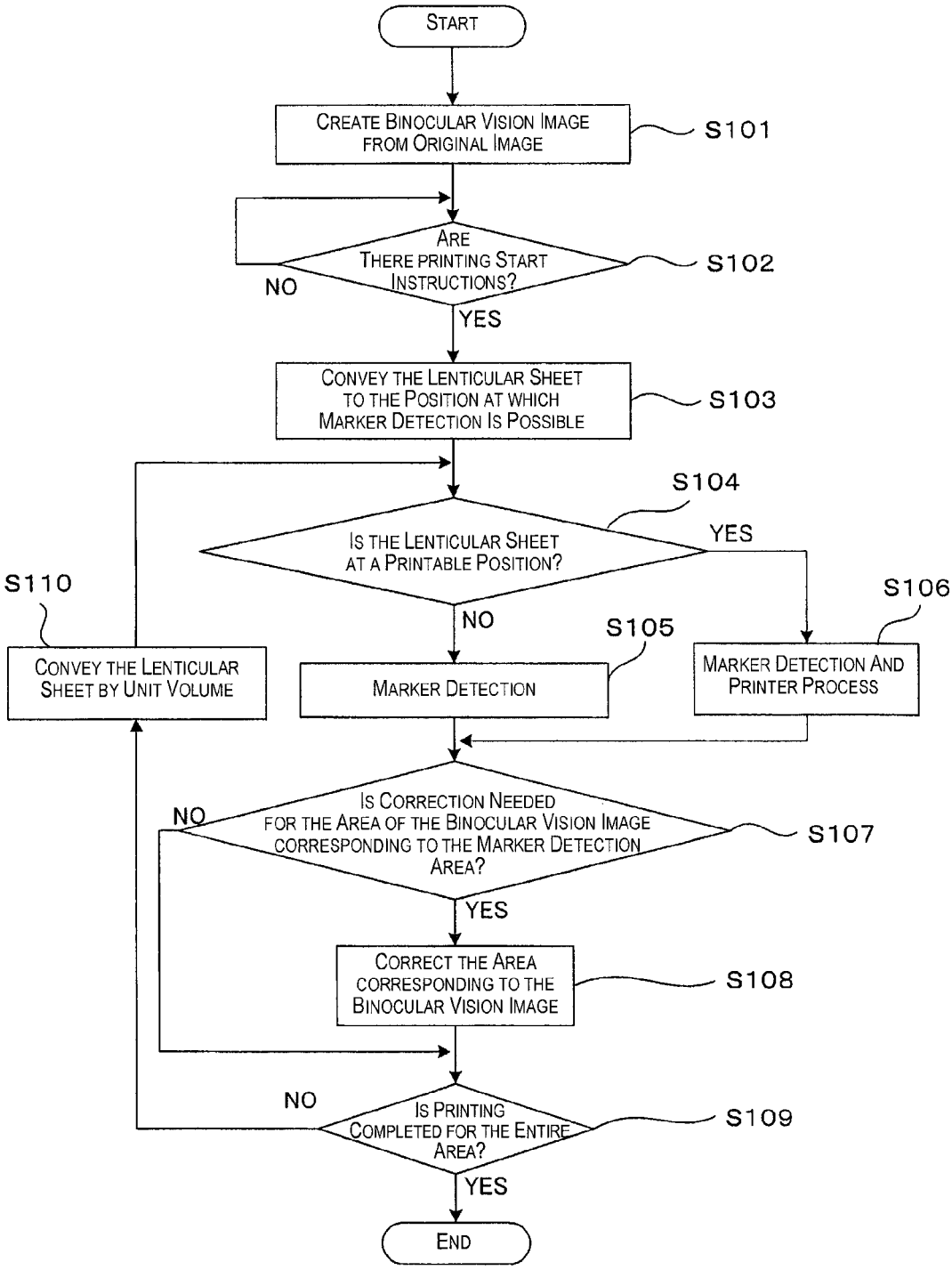
FIG. 3 is a flow chart showing the 3D image printing mode with this embodiment.

FIG. 3 is a flow chart showing the 3D image printing mode with this embodiment. With the 3D image printing mode, initially, a binocular vision image is created from the original images (step S101). As the original images, a plurality of images having disparity between them are necessary, and here for example, a pair of images captured with the stereo imaging mode of the digital camera 200 noted above is used. The original images are not limited to this, and it is also possible to apply the technology described hereafter on a set of a plurality of images for which the same imaging subject was imaged from different viewpoints, or a set of images created using computer graphic technology, for example. For the numbers constituting one set of images, any number of 2 or greater is acceptable.

Figure 4:
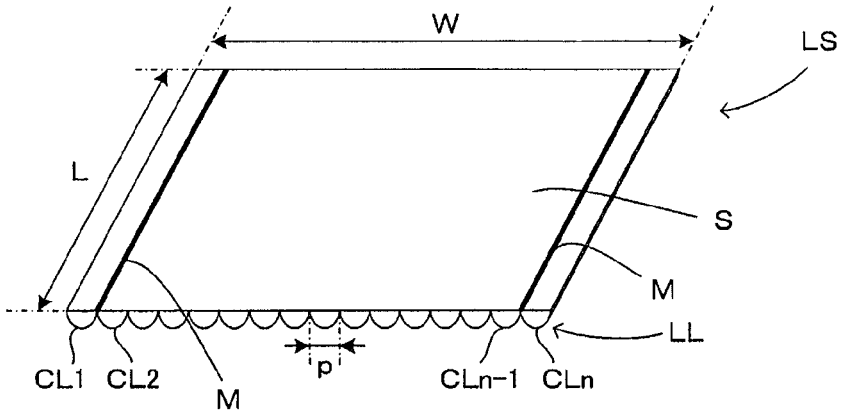
FIG. 4 is a drawing showing a lenticular sheet used with this embodiment.

FIG. 4 is a drawing showing the lenticular sheet used with this embodiment. The lenticular sheet LS has a lenticular lens LL formed by aligning a plurality of convex lenses CL extending in a designated direction. Here, for each convex lens CL, code numbers CL1, CL2, . . . CLn−1, CLn are given in sequence from the item at the left edge in the drawing. Of the main surfaces of the lenticular sheet LS, the surface on the opposite side to the convex surface of the lenticular lens LL is a recording surface S, and the binocular vision image is printed on this recording surface S. Here, as the specified dimensions of the lenticular sheet LS, the width is W, the length is L, and the width of each convex lens CL is p.

Also, on the recording surface S of the lenticular sheet LS, two straight lines of markers M are marked extending across the entire area of the lengthwise direction of the convex lens CL. The markers M are parallel to each other, and in the direction orthogonal to the lengthwise direction of the convex lens CL (hereafter called the "width direction"), these are marked on the boundary line of the convex lens CL1 positioned at the left edge of the drawing and the convex lens CL2 adjacent to it, and on the boundary line of the convex lens CLn positioned at the right edge of the drawing and the convex lens CLn−1 adjacent to it. Here, the width W of the lenticular sheet LS matches the value for which the number n of the convex lenses CL is multiplied by the width p of the convex lens CL, and the outside edges of the convex lenses CL1 and CLn positioned at both edges in the width direction match the edges of the lenticular sheet LS. Specifically, there is one each of the convex lens CL existing further to the outside than each marker M, and there are also (n−2) convex lenses CL existing in the area sandwiched by both markers M.

Here, to obtain a suitable 3D image, it is necessary to have precise alignment of the strip form images described later with each convex lens CL. Considering that there are cases when the lenticular sheet LS (and the convex lens CL) shrinks due to environmental changes such as the temperature, with this embodiment, as described later, the strip form image width and position are adjusted based on the detection results of the markers M. If the number of convex lenses CL between both markers M is already known, it is possible to find the width of each convex lens CL from the distance between both detected markers M. Also, by determining the position of the marker M in relation to each convex lens CL, it is possible to find the position of each convex lens CL in the width direction from the position of the detected markers M. In this case, by having as large a number as possible for the convex lenses CL between the markers M as described above, even if there is an error in the detection results of the marker M, it is possible to reduce the error of the width of the convex lens CL found based on the distance between the markers M. When the error in the width of the convex lens is large, and a binocular vision image is created by aligning strip form images adjusted based on this width, there is the risk that the cumulative error will not be negligible. However, by having as many convex lenses CL included between the markers M as possible and reducing the calculation error of the width of the convex lens CL, it is possible to suppress the aforementioned cumulative error.

Also, the markers M are drawn using ink that can reflect infrared rays emitted from the paper edge detection sensor 1137 described above. As this kind of ink, by selecting an item that is not easily recognizable by the human eye, it is possible to suppress interference of the markers M on the binocular vision image printed on the lenticular sheet LS, so this is preferable. The mode of the marker M is not limited to the item described above. For example, it is also possible to have the position at which the marker M is marked be another position as long as the gap between markers M is an integral multiple of the width p of the convex lens CL, and 3 or more markers M can be provided. Also, the markers M do not absolutely have to be marked extending across the entire area in the lengthwise direction of the convex lens CL, and it is also possible to have the markers M be dotted lines or the like.

Figure 5:
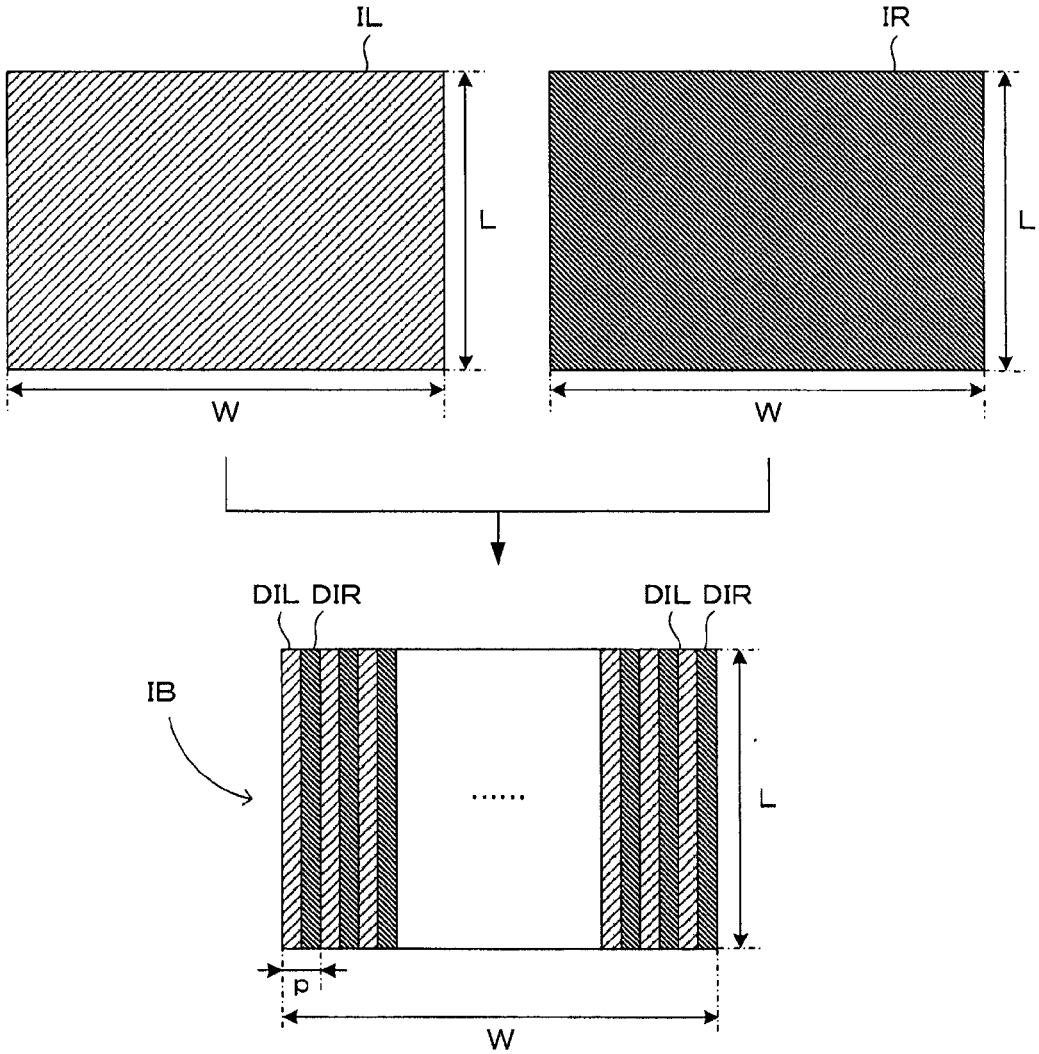
FIG. 5 is a drawing showing a typical method of creating a binocular vision image.

FIG. 5 is a drawing showing the typical method of creating the binocular vision image. The original image IL is an item for which an image captured by the CCD 204L arranged at the left side on the digital camera 200 is adjusted to the width W and the length L matching the dimensions of the lenticular sheet LS, and is used as the original image of the left eye image. Meanwhile, the original image IR is an item for which the image captured by the CCD 204R arranged at the right side in the digital camera 200 is adjusted to the width W and the length L matching the dimensions of the lenticular sheet LS, and is used as the original image of the right eye image. Then, by alternately aligning the plurality of strip form images DIL cut out from the original image IL and the plurality of strip form images DIR cut out from the original image IR, the binocular vision image IB is created. In more specific terms, the binocular vision image IB is created with the strip form images DIL and DIR aligned such that one set of strip form images DIL and DIR in an amount of the number of viewpoints (here, this is 2) aligned in the disparity direction is printed in the area of the recording surface S facing opposite one convex lens CL. Specifically, the width of each strip form image DIL and DIR is adjusted so as to be a value for which the width p of the convex lens CL is divided by the number of viewpoints, and for example with this embodiment, the width p of the convex lens CL is divided by the number of viewpoints which is 2 to result in p/2.

Returning to FIG. 3, we will explain the continuation of the 3D image printing mode. When the binocular vision image IB is created at step S101, a determination is made of whether or not the CPU 101 received printing start instructions from the user via the operating button 109, for example (step S102). When it is determined that printing start instructions were received, the lenticular sheet LS is conveyed to the position for which it is possible for the marker M to be detected. Here, the lenticular sheet LS is conveyed in a state with the lengthwise direction of the convex lens CL along the conveyance direction. The determination of whether or not the lenticular sheet LS has been conveyed to a position at which it is possible for the marker M to be detected can be performed based on the detection results of the front edge of the lenticular sheet LS by the paper edge detection sensor 1137, for example.

Figure 6A:
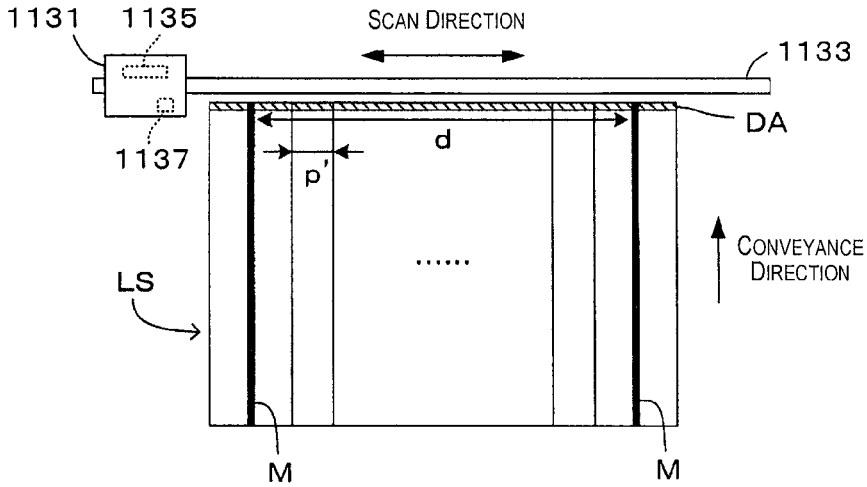
FIGS. 6A-6C are drawings for explaining the marker detection area and the printable area.
Figure 6B:
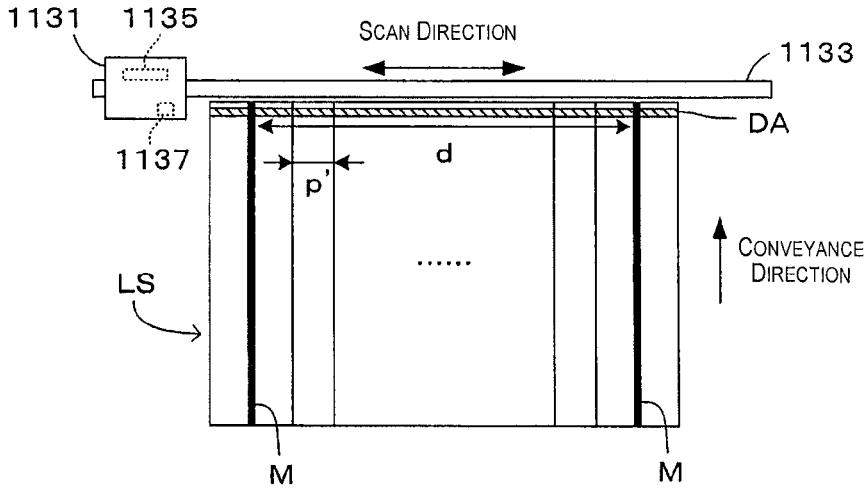
Figure 6C:
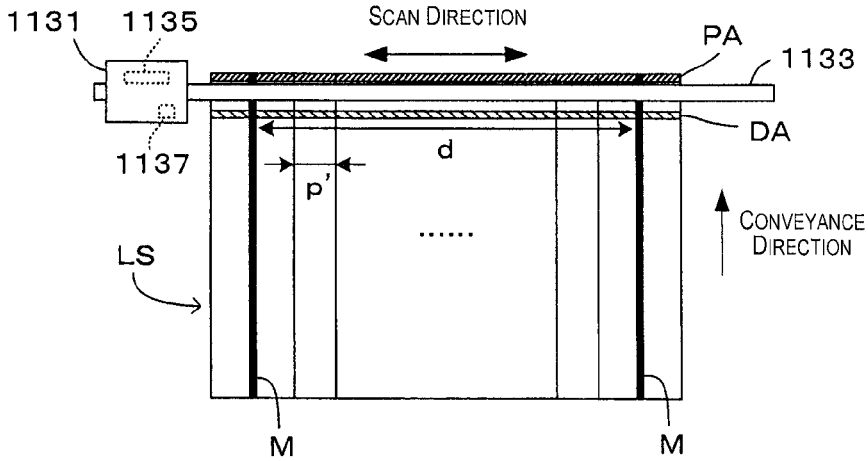

FIG. 6A-6C are drawings for describing the marker detection area and the printable area. FIG. 6A shows the state when step S103 is executed, and the lenticular sheet LS is conveyed to a position for which it is possible to detect the marker M. At this time, the area of the front edge (the top edge in the drawing) in the conveyance direction of the lenticular sheet LS is a marker detection area DA. The marker detection area DA indicates the area for which detection of the marker M is performed by the paper edge detection sensor 1137, and is a long thin area along the scan direction. As the lenticular sheet LS is conveyed, the marker detection area DA moves gradually to the area of the upstream side (downstream in the drawing) of the conveyance direction of the lenticular sheet LS.

Next, a determination is made of whether or not the lenticular sheet LS is in a printable position (step S104). As described above, the paper edge detection sensor 1137 is provided further to the upstream side in the conveyance direction than the printing head 1135. Therefore, even with the lenticular sheet LS in a state for which the marker M can be detected using the paper edge detection sensor 1137, this does not necessarily mean it is in a state for which the printing process is possible by the printing head 1135 on the lenticular sheet LS. Here, whether or not the lenticular sheet LS is in a printable position can be performed based on the timing at which the front edge of the lenticular sheet LS was detected by the paper edge detection sensor 1137, for example, and on the conveyance distance of the lenticular sheet LS. For example, when in the state shown in FIG. 6A the lenticular sheet LS is not conveyed to a state for which the lenticular sheet LS exists directly beneath the scan position of the printing head 1135, and it is determined that the lenticular sheet LS is not in a printable position (step S104, No). In this case, the head unit 1131 is moved in the scan direction along the guide 1133, and only marker detection by the paper edge detection sensor 1137 is executed, in a state without performing printing processing (step S105).

When the marker M detection is performed at step S105, a determination is made of whether or not correction is needed for the binocular vision image IB area corresponding to the marker detection area DA of the lenticular sheet LS (step S107). In specific terms, the distance d between markers M is found from the detection results of the marker M, and by dividing this distance d by the number of convex lenses CL (n−2) that exist between the markers M, the width p' of the convex lens CL in the marker detection area DA is found. Then, when this width p' is compared to the standard width p of the convex lens CL and it is within the allowed range, it is determined that correction of the binocular vision image IB area corresponding to the marker detection area DA is not needed (step S107, No), and step S108 is omitted. Meanwhile, when the width p' is not within the aforementioned allowed range, it is determined that correction of the binocular vision image IB area corresponding to the marker detection area DA is needed (step S107, Yes), and subsequently, correction of that area is performed (step S108). Then, for the area for which correction was unnecessary, the binocular vision image IB image data created at step S101 is used as is, and for the area for which correction was necessary, an item for which the binocular vision image IB image data created at step S101 is corrected as described later is used.

FIGS. 7A and 7B are drawings for explaining the correction of the binocular vision image area corresponding to the marker detection area. Hereafter, the binocular vision image IB area corresponding to the marker detection area DA of the lenticular sheet LS at a certain point in time, specifically, the binocular vision image IB area to be printed in the marker detection area DA, is called the correspondence area CA. FIG. 7A shows the correspondence area CA of the binocular vision image IB created at step S101 corresponding to the marker detection area DA in FIG. 6A. Also, FIG. 7B shows the correspondence area CA' after correction of the correspondence area CA based on the detection of the marker M. As shown in FIG. 7A, the width of the strip form images DIL and DIR in the correspondence area CA before correction is p/2 to match the standard width p of the convex lens CL. Then, when the convex lens CL width p' found from the marker M detection results is not within the allowed range, strip form images DIL' and DIR' for which the width of the strip form images DIL and DIR for the correspondence area CA is adjusted to p'/2 are aligned, and image data is created for the post-correction correspondence area CA'. In this way, by adjusting the width of the strip form images DIL and DIR based on the width p' of the convex lens CL during printing, for example, even when the width of the convex lens CL changes with shrinkage of the lenticular sheet LS due to environmental changes such as temperature, for example, it is possible to provide image data for which the width of one set of strip form images in the amount of the number of viewpoints is the same as the width of one convex lens CL.

Next, a determination is made of whether or not printing is completed for the entire area of the binocular vision image on the lenticular sheet LS (step S109). When it is determined that printing has not been completed (step S109, No), after the lenticular sheet LS is conveyed by unit volume (step S110), the process returns to step S104. Here, a unit volume can be, for example, the volume that the lenticular sheet LS is conveyed to perform the next row of printing after 1 scan row of printing has been completed in the scan direction by the head unit 1131, but it can also be a volume set based on other criteria.

FIG. 6B shows the state for which the lenticular sheet LS has been conveyed by the unit volume from the state in FIG. 6A, and FIG. 6C shows the state when the lenticular sheet LS has been conveyed to the printable position. In the state in FIG. 6B, the lenticular sheet LS remains as is not existing directly under the scan position of the printing head 1135, and it is determined that the lenticular sheet LS is not in a printable position (step S104, No). In this case, the process flow from step S105 and thereafter as has already been explained is executed repeatedly. Then, while the lenticular sheet LS is being conveyed by the unit volume repeatedly in the conveyance direction, as shown in FIG. 6C, the lenticular sheet LS comes to be positioned directly under the scan position of the print head 1135. At this time, it is determined that the lenticular sheet LS is in a printable position (step S104, Yes), and marker detection and print processing are executed simultaneously (step S106). In this way, each time the lenticular sheet LS is conveyed by a unit volume, the marker M is detected, and if necessary, by performing correction of the strip form images DIL and DIR based on those detection results, even when a change occurs in the width of the lenticular sheet LS (and convex lens CL) in the conveyance direction, the width of the strip form images DIL and DIR is adjusted according to that width change, so this is preferable. Note that marker detection and image correction do not have to be executed each time the lenticular sheet LS is conveyed by a unit volume, and can be suitably executed using other timing as well.

In FIG. 6C, the area of the lenticular sheet LS for which printing is possible is indicated as printable area PA. This printable area PA corresponds to the marker detection area DA in FIG. 6A. Therefore, when it has been determined that correction is unnecessary at step S107, the image of the correspondence area CA, and when it has been determined that correction is necessary at step S107, the image of the post-correction correspondence area CA' is printed in the printable area PA. Specifically, when it is determined that correction is necessary for the correspondence area CA from the marker detection results in the marker detection area DA at a certain point in time, the image of the correspondence area CA' corrected based on those marker detection results is printed on the lenticular sheet LS when that marker detection area DA is conveyed to the position which will be the printable area PA. Meanwhile, when it is determined that correction is not necessary for the correspondence area CA from the marker detection results in the marker detection area DA at a certain point in time, the image of the correspondence area CA for which correction is not performed is printed on the lenticular sheet LS when that marker detection area DA is conveyed to the position which will be the printable area PA.

Here, with the device of this embodiment, the paper edge detection sensor 1137 is provided on the head unit 1131 on which the print head 1135 is provided. Therefore, as a mechanism for moving the paper edge detection sensor 1137, it is possible to use the movement mechanism of the head unit 1131, so there is no interference of the paper edge detection sensor 1137 and the head unit 1131, and it is possible to simplify the device structure. Also by moving the head unit 1131 in the scan direction, it is possible to simultaneously execute the marker detection by the paper edge detection sensor 1137 and the print processing on the lenticular sheet LS.

When the print processing is executed, alignment of the binocular vision image in relation to the lenticular sheet LS is performed based on the relative position of the marker M for which the marker M detection results by the paper edge detection sensor 1137 are known in advance and the convex lens CL. More specifically, alignment of the image of the correspondence area CA (or CA') in relation to the lenticular sheet LS is performed. For example, when printing the image of the post-correction correspondence area CA' on the marker detection area DA (specifically, the printable area PA in FIG. 6C) of the lenticular sheet LS in FIG. 6A, based on the detection results of the detection means, the printing start position in the scan direction by the print head 1135 is adjusted so as to be a position further to the outside than the marker M detection position by an amount width p' of the convex lens CL. By doing this, it is possible to align such that the edge of the width direction of the lenticular sheet LS and the edge of the image of the correspondence area CA' match. The lenticular lens is for example created from narrow pitch convex lenses of approximately 20 to 100 lpi (lines per inch), for example, and the precision for obtaining alignment is extremely strict. However, as described above, by executing as necessary alignment of the image of each correspondence area CA (or CA') in relation to the lenticular sheet LS according to the detection results of the marker M, it is possible to stand up to even strict precision requirements.

FIG. 8 is a drawing showing the state with the lenticular sheet being conveyed at a tilt. As described above, by executing as necessary alignment of the image of each correspondence area CA (or CA') in relation to the lenticular sheet LS according to the marker M detection results, it is possible to print an image with good precision even when the lenticular sheet LS is being conveyed at a tilt as in FIG. 8. First, the width p' in the scan direction of the convex lens CL is found from the marker detection results in the marker detection area DA of the lenticular sheet LS, and the image of the correspondence area CA is corrected based on this width p' (see FIGS. 7A and 7B). Furthermore, alignment of the image of each correspondence area CA (or CA') in relation to the lenticular sheet LS is executed as necessary based on the results of detecting the marker M position. Therefore, even in a case such as when the position of the marker M in the scan direction changes constantly as in FIG. 8, width adjustment of the image and alignment are performed based on the marker detection results immediately before printing, so it is possible to improve the printing precision.

The printing control by the 3D image printing mode above is performed repeatedly until printing of the entire area of the binocular vision image IB is completed. Therefore, it is possible to print on the lenticular sheet in a state for which the image data according to the width of the convex lens CL during printing, specifically, each strip form image DIL and DIR (or DIL' and DIR') do not extend across a plurality of convex lenses CL. As a result, the binocular vision image as an aggregate of the strip form images DIL and DIR (or DIL' and DIR') can be suitably viewed in 3D via the lenticular lens LL. In fact, the markers M are marked on the lenticular sheet LS along the lengthwise direction of the convex lens CL, and the lenticular sheet LS is conveyed in a state with the lengthwise direction of the convex lens CL along the conveyance direction. Therefore, with one scan, it is possible to detect both markers M, and it is possible to immediately find the width of the convex lens CL and to adjust the width of the strip form images DIL and DIR. Specifically, it is possible to quickly provide the width adjusted image data before printing, and it is possible to smoothly implement a series of operations of marker detection, supplying of image data, and print processing.

As described above, with this embodiment, the printer engine controller 111 and the head unit 1131 of the printer engine 113 function as the "printing means" of the invention, and the printer engine controller 111 and the conveyer roller 1136 of the printer engine 113 function as the "conveyance means" of the invention. Also, the paper edge detection sensor 1137 functions as the "marker detection means" of the invention, and by executing a designated control program, the CPU 101 realizes the function as the "image data supply means" of the invention.

The invention is not limited to the embodiments noted above, and it is possible to perform various modifications other than the items described above as long as they do not stray from the gist. For example, with the embodiment noted above, the binocular vision image IB was created using the original images IL and IR from two viewpoints left and right, but as long as the number of original images is 2 or greater, it is possible to apply the technology noted above even when creating the binocular vision image from original images of a large number of viewpoints.

Also, with the embodiment noted above, after creating the binocular vision image IB in advance based on the specified dimensions of the lenticular sheet LS at step S101, only in a case when it is determined that correction is necessary for the correspondence area CA corresponding to the marker detection area DA from the marker detection results of a certain marker detection area DA is correction done of the image data of the binocular vision image IB contained in that correspondence area CA. However, it is also possible to not create the binocular vision image IB at step S101, and to create image data of the correspondence area CA corresponding to that marker detection area that reflects the detection results for the first time after doing marker M detection in the marker detection area DA.

Also, with the embodiment noted above, the binocular vision image IB was corrected as necessary together with detection of the marker M for each unit volume conveyance of the lenticular sheet LS. However, the marker M detection timing and the binocular vision image IB correction timing are not limited to this. For example, it is also possible to initially do marker M detection only once, and based on those results, to correct the entire area of the binocular vision image IB, and also to perform the marker M a plurality of times at designated timings, and each time, to correct a designated area of the binocular vision image IB.

The printing device and printing method of the invention can be applied when printing on the lenticular sheet a binocular vision image for which strip form images cut out from each of the plurality of original images having disparity to each other are aligned.

What is claimed is:

1. A printing device for printing a binocular vision image, for which are aligned strip form images cut out individually from a plurality of original images having disparity with each other, on a lenticular sheet having a lenticular lens formed by aligning a plurality of convex lenses extending in a designated direction, comprising:

conveyance unit that conveys the lenticular sheet with the lengthwise direction of the convex lens along the conveyance direction, marker detection unit that detects a plurality of markers marked on the lenticular sheet, parallel to each other along the lengthwise direction with a gap of an integral multiple of the convex lens width opened, image data supply unit that supplies image data with the width of the strip form image adjusted according to the width of the convex lens found from the detection results of the marker detection unit, and printing unit that receives image data supplied from the image data supply unit and printing the binocular vision image on the lenticular sheet.

2. A printing device according to claim 1, wherein the printing unit adjusts the printing start position on the lenticular sheet in the direction orthogonal to the conveyance direction based on the detection results of the marker detection unit.

3. A printing device according to claim 1, wherein the image data supply unit adjusts the width of the strip form image based on the detection results of the plurality of markers marked on the lenticular sheet with a gap of 2 times or greater than the width of the convex lens opened.

4. A printing device according to claim 1, wherein the image data supply unit adjusts the width of the strip form image based on the detection results of the markers marked on two boundary lines positioned at both edges in the direction orthogonal to the lengthwise direction among the boundary lines of mutually adjacent convex lenses.

5. A printing device according to claim 1, wherein the marker detection unit performs detection of the markers a plurality of times at different timings for the lenticular sheet conveyed in the conveyance direction, and the image data supply unit adjusts the width of the strip form image based on the detection results of the marker detection unit each time the marker is detected.

6. A printing device according to claim 1, wherein the printing unit has a head unit for performing printing on the lenticular sheet while moving it in the direction orthogonal to the conveyance direction, and the marker detection unit is provided on that head unit.

7. A printing device according to claim 1, wherein the marker detection unit performs detection of the marker by receiving the light of the outgoing beams of the wavelength components other than the visible light range from the markers.

8. A printing device according to claim 1, wherein the marker detection unit detects the edge of the lenticular sheet in the direction orthogonal to the conveyance direction.

9. A printing method for printing a binocular vision image, for which are aligned strip form images cut out individually from a plurality of original images having disparity with each other, on a lenticular sheet having a lenticular lens formed by aligning a plurality of convex lenses extending in a designated direction, comprising:

preparing the lenticular sheet on which a plurality of markers are marked parallel to each other along the lengthwise direction of the convex lens with a gap of an integral multiple of the width of the convex lens opened, conveying the lenticular sheet with the lengthwise direction along the conveyance direction, detecting the plurality of markers marked on the lenticular sheet, supplying image data for which the width of the strip form image is adjusted according to the width of the convex lens found from the detection results of the detecting, and printing the binocular vision image on the lenticular sheet based on the image data supplied at the supplying.

* * * * *